United States Patent [19]

Zierler

[11] Patent Number: 4,656,921

[45] Date of Patent: Apr. 14, 1987

[54] GUN WITH RECOIL AND COUNTER RECOIL MEANS

[75] Inventor: Reinhard Zierler, Micheldorf, Austria

[73] Assignee: Voest-Alpine Aktiengesellschaft, Austria

[21] Appl. No.: 733,365

[22] Filed: May 13, 1985

[30] Foreign Application Priority Data

May 29, 1984 [AT] Austria ..... 1773/84

[51] Int. Cl.[4] ..... F41F 19/02

[52] U.S. Cl. ..... 89/43.01

[58] Field of Search ..... 89/43.01, 177, 178

[56] References Cited

U.S. PATENT DOCUMENTS

| | | | |
|---|---|---|---|
| 415,569 | 11/1889 | Schneider | 89/43.01 |
| 2,395,488 | 2/1946 | Lucht | 89/43.01 |
| 2,442,371 | 6/1948 | Meyers et al. | 89/43.01 |
| 2,454,818 | 11/1948 | Lucht | 89/43.01 X |
| 2,715,856 | 8/1955 | Kramer et al. . | |
| 4,038,905 | 8/1977 | DuPont, Jr. et al. . | |
| 4,296,670 | 10/1981 | Northup et al. | 89/43.01 |

OTHER PUBLICATIONS

"Waffenlehre fur die Bundeswehr" (Obstlt. H. Dathan, 2. Aufl., Verlag Offene Worte, Bonn; p. 117/FIG. 64).

*Primary Examiner*—John F. Terapane
*Assistant Examiner*—John S. Maples
*Attorney, Agent, or Firm*—Cushman, Darby & Cushman

[57] ABSTRACT

In a gun which is provided with a recoil cylinder (8) against the recoil (11) and with a counter recoil cylinder (15) which cylinder (15) is filled with a hydraulic fluid, said recoil cylinder (8) and counter recoil cylinder (15) are mainted coaxially with the gun tube (1), wherein the counter recoil cylinder (15) encloses the gun tube (1) and the recoil cylinder (8) encloses the counter recoil cylinder (15). Therein the cylinder part (16) of the counter recoil cylinder (15) forms the piston part (7) of the recoil cylinder (8). The piston part (7) of the recoil cylinder (8) comprises a piston (10) which is guided within the cylinder part (9) of the recoil cylinder (8) leaving clear an annular gap (12), wherein the inner surface (13) of the cylinder part (9) of the recoil cylinder (8) is tapering towards the breech end.

9 Claims, 1 Drawing Figure

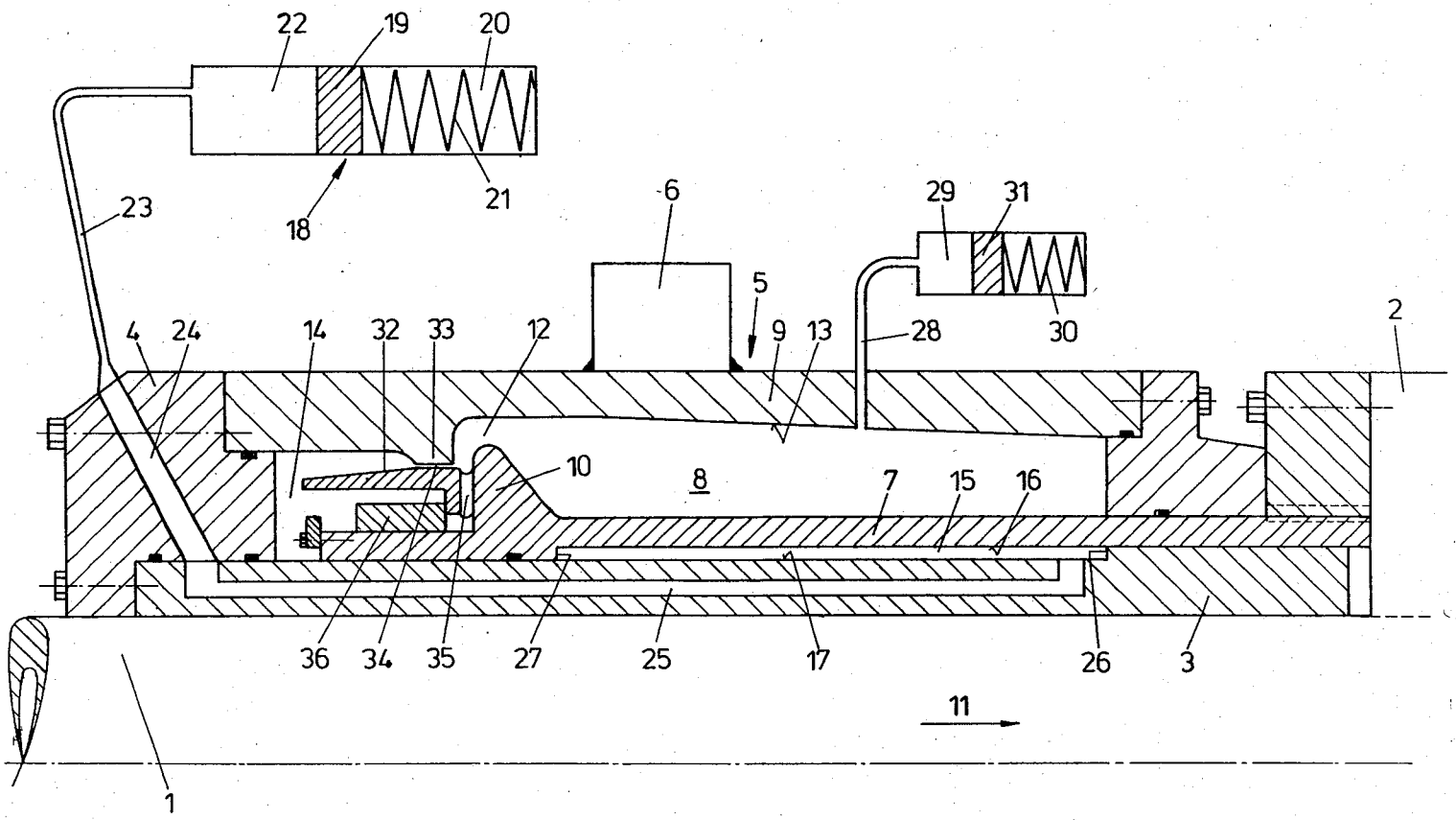
2
3
26
30
31
29
28
16
15
11
7
13
9
5
17
8
6
25
10
12
27
20
21
33
35
19
32
34
18
36
22
14
24
4
23
1

GUN WITH RECOIL AND COUNTER RECOIL MEANS

The invention relates to a gun whose tube is mounted slidably in axial direction on a cradle pivotally mounted on a gun carriage, and which is supported upon the cradle against the impact of the recoil by a recoil cylinder filled with a hydraulic fluid, comprising a piston and enclosing the tube coaxially, where a counter recoil cylinder is provided, comprising a piston and filled with a hydraulic fluid. It is well-known for a long time to place the recoil and counter recoil cylinders is a gun eccentrically to the gun tube, i.e. above, below or laterally thereof. A disadvantage therein is, however, the fact that the recoil force is absorbed eccentrically, through which may result an error of the firing angle, which decreases the precision of the shot. Apart from that the dimensions of the construction of a gun are enlarged. From U.S. Pat. No. 2,715,856 and U.S. Pat. No. 4,038,905 it is known to place the recoil cylinder and the counter recoil cylinder coaxially with the gun tube, wherein the counter recoil cylinder is identical with the recoil cylinder. In the device described in U.S. Pat. No. 2,715,856 a helical spring is arranged within the recoil cylinder, which partly absorbs the brake force and effects the recuperation of the gun tube. A disadvantage of this construction is, however, the fact that the helical spring is damaged through the generation of heat during firing and abates, through which the recuperation of the gun tube is affected. Furthermore there exists the danger of a rupture of the spring, whereupon the gun becomes useless, because the tube stays in the rearward position after the first shot and after the next firing the recoil has to be absorbed totally through the gun carriage. This strain may result in the rupture of the journals, which may endanger the gun crew. In the device described in U.S. Pat. No. 4,038,905 the working area of the piston is filled with an elastically compressible liquid. Through the recoil force the liquid is compressed and the tube is recuperated after the firing through the compressible liquid. Disadvantageous is, however, that only part of the length of the recoil cylinder can be used for the absorption of the recoil forces, because in the remaining part of the recoil cylinder there must remain enough liquid to effect the recuperative movement.

It is the aim of this invention to improve the braking effect of the recoil cylinder and to guarantee the recuperation of the gun tube. To fulfill this task the essential characteristic of this invention is that the counter recoil cylinder is mounted coaxially with the gun tube and that the recoil cylinder encloses the counter recoil cylinder. Because of the arrangement of the recoil cylinder and the counter recoil cylinder coaxially with the gun tube, a centered support of the gun tube is guaranteed during firing. Because of the provision of a separate recoil cylinder and a separate counter recoil cylinder, the whole length of the recoil cylinder can be used for the absorption of the recoil forces. The recoil forces can therefore be absorbed over a great length of the recoil cylinder and the separate counter recoil cylinder guarantees that the gun tube is recuperated into its initial position for the next shot so that for the next shot the whole stroke of the piston of the recoil cylinder can be used. The counter recoil cylinder has to exercise only substantially smaller forces than the recoil cylinder must be able to absorb after firing. Therefore the counter recoil cylinder may have a substantially smaller diameter and piston area than the recoil cylinder. Because the recoil cylinder is arranged outside and encloses the counter recoil cylinder, a sufficiently large working area may be provided for the piston in the recoil cylinder.

According to a preferred embodiment of the invention the cylinder part of the counter recoil cylinder forms the piston part of the recoil cylinder, whereby an embodiment of simple construction is created. Therein the cylinder part of the recoil cylinder forms the gun cradle and also includes the journals for the support on the gun carriage. According to the invention the piston part of the counter recoil cylinder is preferably rigidly connected with the cylinder part of the recoil cylinder and forms the shifting guide of the gun tube. Therein the cylinder part of the counter recoil cylinder, which forms the piston part of the recoil cylinder, is advantageously rigidly connected with the gun tube. Advantageously the cylinder part of the counter recoil cylinder is rigidly connected with the part of the gun tube comprising the breech. Thereby a simple construction results. Because of the construction of the cylinder part of the counter recoil cylinder as the piston part of the recoil cylinder, separate components are saved and the diameter of the whole construction remains small. The same advantages are valid for the construction of the piston part of the counter recoil cylinder as the shifting guide of the gun tube. Because of the rigid connection of the cylinder part of the counter recoil cylinder, being the piston part of the recoil cylinder, with the gun tube and because the cylinder part of the recoil cylinder forms the cradle, the braking forces are transmitted immediately from the gun tube to the gun cradle.

According to another preferred embodiment of this invention the arrangement is such that the piston of the recoil cylinder is guided in the cylinder part thereof over the whole length of the recoil cylinder providing an annular gap and that the clear opening of the cylinder part of the recoil cylinder tapers in the direction of the rear end or of the breech of the gun tube. The annular gap forms a choke gap between the piston and the external recoil cylinder, where through the choked passage of the hydraulic fluid from one side of the piston to the other side a brake effect is achieved. Because the clear opening of the cylinder part of the recoil cylinder tapers in the direction of the breech end of the gun tube, the annular gap between the piston of the recoil cylinder and the inner surface thereof decreases during the recoil movement. The inner surface of the external recoil cylinder is formed in such a way that the brake force is almost constant over the whole backward motion, through which the maximum strain on the journals can be kept as small as possible. According to the invention the inner surface of the cylinder part of the recoil cylinder may follow an empirical curve along a longitudinal section thereof. In this way the resulting brake force may be accordingly adjusted over the whole length of the recoil movement. According to the arrangement of U.S. Pat. No. 2,715,856 the diameter of the recoil cylinder also increases conically over a part of the recoil length. This enlargement extends approximately over half the length of recoil length, whereas in the second half of the recoil length the piston of the recoil cylinder is guided in a comparatively snug fit in the recoil cylinder. Thus it is not possible to allow a gradual brake effect over the whole length of the recoil, which course may be determined empirically. Therefore the journals of the gun cradle are overstrained in an uncontrollable manner nearing the end of the recoil.

According to a preferred embodiment of this invention the arrangement is such that the cylinder part of the recoil cylinder has an annular protrusion protruding toward the inner part on the side of the piston of the recoil cylinder facing the muzzle at the resting position of the piston, which annular protrusion surrounds a surface of revolution of the piston part of the recoil cylinder tapering in the direction of the muzzle and providing an annular gap. During the counter recoil movement of the gun tube the piston of the recoil cylinder is moved towards the resting position. At the end of the shifting movement the surface of revolution, which is tapering in the direction of the muzzle, of the piston part engages with the annular protrusion of the cylindrical part of the recoil cylinder and during this movement the annular gap forms a continuously decreasing choke gap for the hydraulic medium passing from one side of the piston to the other side thereof, through which the counter recoil movement is gradually slowed down. The choke effect of this annular gap arises also during the recoil movement and it should be avoided that a vacuum is created in the chamber on the part of the piston facing the muzzle because of a too large choke effect. To avoid the creation of such a vacuum the piston part of the recoil cylinder has at least one opening between the piston and the surface of revolution, which is controlled through a check valve closing toward the working area of the piston. At the beginning of the recoil movement the check valve is open and therefore the choke gap is increased. In a simple embodiment of this invention the check valve is a ring, shifting freely in axial direction on the piston part of the recoil cylinder. Because of the free movability of the ring, it lags behind due to inertia during the recoil movement and clears one or more openings, thereby decreasing the choke effect. Such a construction offers the advantage not to include any springs for the check valve.

Because the working area of the recoil cylinder encloses the gun tube, rapid firing can cause a heating of the hydraulic fluid filling the working area, thereby increasing the volume of the hydraulic fluid. To compensate for this effect, according to the invention the working area of the recoil cylinder can be in hydraulic connection with a compensating cylinder designed as a pressure accumulator.

According to the invention the working area of the piston of the counter recoil cylinder is advantageously connected with a hydraulic energy accumulator, being under the pressure of a gas or a spring. During the recoil movement this energy accumulator is charged and the stored energy is used for the counter recoil movement of the gun tube.

In the construction according to this invention mechanical springs are avoided at least in these parts enclosing the gun tube, which are exposed to large heating. For those mechanical springs there exists the danger of their abating, especially in heated areas, and such abating leads to uncontrollable conditions. In those aggregates being apart from the areas which are directly heated through the gun tube, such as the compensating cylinder or the energy accumulator, mechanical springs can be included.

In the drawing the invention is described schematically by way of example. The drawing shows a longitudinal section through the recoil cylinder and the counter recoil cylinder enclosing the gun tube.

In the drawing is shown the gun tube 1 with the breech 2 at the rear end. The gun tube 1 is held slidingly in axial direction by a cylindrical sleeve 3. The cylindrical sleeve 3 is rigidly connected with the cradle 5 through a coupling link 4, which cradle 5 carries the journals 6 for the support on a gun carriage (not shown). The working area of the recoil cylinder is designated 8. The cylindrical part 9 of the recoil cylinder is simultaneously the cradle 5. The piston part 7, which carries the piston 10, is rigidly connected with the breech 2. During the recoil the piston part 7 with the gun tube 1 moves in the direction indicated by arrow 11, whereas the cylindrical part 9 forming the cradle 5 is supported at the gun carriage. The hydraulic fluid is pressed out of the working area 8 of the recoil cylinder by the piston 10 and gets through a choke gap 12 between the piston 10 and the inner surface 13 of the cylinder part of the recoil cylinder to the other side of the piston 10 into a chamber 14. This choke gap causes the braking effect on the recoil.

The counter recoil cylinder and the working area thereof are designated 15. Part 7 forms the cylinder part 16 of the counter recoil cylinder and part 3 is the piston part 17 of the counter recoil cylinder. 18 is an energy accumulator with a piston 19 and a working area 20, in which is located a spring, designated 21, or a gas reservoir. The chamber 22 of the energy accumulator 18 is connected with the working area of the counter recoil cylinder 15 through a line 23, a channel 24 and a channel 25. The working area of the counter recoil cylinder 15 is limited on one side through ring surface 26 extending outward of part 3 i.e. the piston part 17 and on the other side through a ring surface 27 extending inward of the cylindrical part 16 of the counter recoil cylinder 15. The hydraulic pressure generated in the energy accumulator 18 causes part 3, i.e. the piston part 17 of the counter recoil cylinder 15 to assume the shown position, because this pressure is exercised between the surfaces 26 and 27. In this way the gun tube 1 is reset into its shown resting position after firing.

The diameter of the working area 8 of the recoil cylinder, limited through the inner surface 13 of the cylinder part 9 thereof, is tapering toward the breech 2. Nearing the end of the recoil movement in the direction of arrow 11, the choke gap 12 gets increasingly smaller so that a nearly constant damping results therefrom.

Through a line 28 a compensating cylinder 29 is connected with the working area 8 of the recoil cylinder, which cylinder 29 comprises a piston 31 charged through a spring 30. If the hydraulic medium in the working area 8 of the recoil cylinder is expanding because of a heating up during rapid firing, this expansion is compensated by the compensating cylinder 29. On the part of the piston 10 facing the muzzle (on the left side of the drawing) the piston part 7 of the recoil cylinder shows a surface of revolution 32 tapering in the direction of the muzzle. This surface of revolution 32 fits into an annular protrusion 33 extending inward from the cylindrical part 9, where an annular gap 34 remains open between the surface of revolution 32 and the annular protrusion 33. This annular gap 34 forms a choke gap, which decreases continuously toward the end of the counter recoil movement of the gun tube 1, by which the counter recoil movement is slowed down. Between the surface of revolution 32 and the piston 10 are provided a number of bores 35, which lead into chamber 14. On the piston part 7 a ring 36 is mounted, which is free to shift. The recoil moves the piston 10, which is rigidly connected with the gun tube 1, rearward in the direction of arrow 11. Because of the inertia of its mass the ring 36 lags behind in motion and opens the bores 35, thereby avoiding the creation of a vacuum in chamber 14 at the beginning of the recoil movement.

I claim:

1. A gun comprising: a gun cradle adapted to be pivotally mounted on a carriage, said cradle having an inner annular part and an outer annular part, said inner part forming a bore through said cradle and said inner and outer parts defining between them an annular hydraulic recoil chamber concentric with and surrounding said bore; a gun tube having a muzzle end and a breech end, said gun tube being mounted in and guided by said bore for longitudinal sliding movement relative to said cradle; an annular recoil piston having an annular piston head and an annular part of reduced diameter relative to said piston head, said piston head being longitudinally slidable in said recoil chamber and said reduced-diameter portion extending from said recoil chamber and rigidly connected to said gun tube at a location outside said recoil chamber so as to move with said gun tube; and an annular hydraulic counter recoil chamber in said cradle coaxial with said gun tube and surrounded by said annular recoil chamber, said annular counter recoil chamber being formed by and between said reduced-diameter portion of said recoil piston and said inner annular part of said cradle, the latter part thereby forming a piston within said annular counter recoil chamber.

2. A gun as in claim 1 wherein said gun tube includes a breech at the location where said reduced-diameter portion of said annular recoil piston is connected to said gun tube.

3. A gun as in claim 1 wherein said outer annular part of said cradle includes an annular protrusion extending radially inward, said protrusion surrounding a surface of revolution of said piston head and defining an annular gap therewith, said surface of revolution tapering radially inward in a direction opposite the direction of recoil.

4. A gun as in claim 1 including a compensating cylinder connected to said recoil chamber by a hydraulic connection.

5. A gun as in claim 1 including a pressurized hydraulic accumulator connected by a hydraulic connection to said counter recoil cylinder.

6. A gun as in claim 1 wherein there is an annular gap between said piston head and said outer annular part of said cradle and wherein the inner surface of said outer annular part of said cradle tapers radially inwardly toward the breech end of said gun tube.

7. A gun as in claim 6 wherein, in a longitudinal section through said outer annular part of said cradle, the inner surface of said part follows an empirical curve.

8. A gun as in claim 1 wherein said recoil piston includes at least one opening extending through said piston head to a portion of said annular recoil chamber on the muzzle side of said piston head and a check valve for closing said opening when said piston head moves in the direction of the muzzle end of said gun tube.

9. A gun as in claim 8 wherein said check valve includes a ring surrounding said piston and longitudinally shiftable thereon.

* * * * *